US009050730B2

(12) United States Patent
Miyawaki

(10) Patent No.: US 9,050,730 B2
(45) Date of Patent: Jun. 9, 2015

(54) SAW SHEATH

(75) Inventor: Shozo Miyawaki, Hyogo (JP)

(73) Assignee: UM: KOGYO INC., Hyogo (JP)

( * ) Notice: Subject to any disclaimer, the term of this patent is extended or adjusted under 35 U.S.C. 154(b) by 0 days.

(21) Appl. No.: 14/115,374

(22) PCT Filed: May 11, 2011

(86) PCT No.: PCT/JP2011/060813
§ 371 (c)(1),
(2), (4) Date: Nov. 4, 2013

(87) PCT Pub. No.: WO2012/153398
PCT Pub. Date: Nov. 15, 2012

(65) Prior Publication Data

US 2014/0069831 A1 Mar. 13, 2014

(51) Int. Cl.

| | |
|---|---|
| ***B65D 6/02*** | (2006.01) |
| ***B26B 29/00*** | (2006.01) |
| ***B26B 29/02*** | (2006.01) |
| ***B27B 21/00*** | (2006.01) |

(52) U.S. Cl.
CPC ..... *B26B 29/00* (2013.01); *B26B 29/025* (2013.01); *B27B 21/00* (2013.01)

(58) Field of Classification Search
USPC ..... 206/349; 224/232, 242; 30/162, 151, 30/504, 514, 164
See application file for complete search history.

(56) References Cited

U.S. PATENT DOCUMENTS

| | | | | | |
|---|---|---|---|---|---|
| 675,252 | A * | 5/1901 | Simmons | 224/232 |
| 2,361,735 | A * | 10/1944 | Beckwith et al. | 224/232 |
| 5,031,810 | A * | 7/1991 | Finn et al. | 224/581 |
| 5,794,347 | A * | 8/1998 | Serpa | 30/162 |
| 6,076,261 | A * | 6/2000 | Eriksson et al. | 30/151 |
| 6,434,838 | B1 * | 8/2002 | Mai | 30/504 |
| 2004/0118722 | A1 * | 6/2004 | Martin | 206/349 |
| 2013/0026054 | A1 * | 1/2013 | Adams | 206/349 |

FOREIGN PATENT DOCUMENTS

| | | |
|---|---|---|
| JP | 63163770 | 10/1988 |
| JP | 07037585 | 11/1995 |
| JP | 2005131073 | 5/2005 |

* cited by examiner

*Primary Examiner* — Jacob K Ackun
(74) *Attorney, Agent, or Firm* — Bacon & Thomas, PLLC

(57) ABSTRACT

A saw sheath is provided which allows a saw to be inserted easily and smoothly, which prevents the inserted saw from easily falling out or rattling in the sheath, and which can suppress scraping-off of the inner wall by the blade tip of the saw blade caught by the inner wall. The saw sheath (1) includes a flat sheath opening section (10) and a flat main sheath body (20), and a saw blade (31) is inserted into the main sheath body (20) via the sheath opening section (10). The sheath opening section (10) has an opening width that is wider at the entrance and becomes narrower with depth. A pair of guide rollers (11*a*) are provided at the entrance of the sheath opening section (10), on the respective sides in the width direction of the entrance, and a pair of grip penetration preventing sections (15) are provided behind the pair of guide rollers (11*a*). Certain spacing between the grip penetration preventing section (15) and the corresponding guide roller (11*a*) constitutes an elastic grip-fitting space (16).

15 Claims, 13 Drawing Sheets

SAW SHEATH

TECHNICAL FIELD

The present invention relates to a saw sheath for housing a blade of a saw.

BACKGROUND ART

Conventionally, as a saw sheath for housing the blade of a saw such as a hand saw, those using guide rollers have been proposed.

For example, Japanese Utility Model Application Laid-Open No. 7-37585 (Patent Document 1) discloses a saw sheath, wherein rigid roller members (4) are rotatably attached to a sheath body (2) near a saw-body inserting opening (3) thereof, such that when a saw body (1) is put in or taken out of the sheath body (2), the roller members may contact and guide the saw body (1). This configuration facilitates the operations of taking the saw body (1) in and out of the sheath body, and also reduces damages to the sheath body (2).

Further, Japanese Patent Application Laid-Open No. 11-9858 (Patent Document 2) discloses a sheath for a saw or the like, wherein a housing section (2) in a shape capable of accommodating a blade portion (4) of the saw or the like is formed inside a main sheath body (1), and rotary rollers (3) are mounted inside the housing section (2) as well as near an opening thereof through which the blade portion (4) is inserted.

On the other hand, Japanese Patent Application Laid-Open No. 2005-131073 (Patent Document 3) discloses a sheath for a saw or the like, wherein a squeezed portion (3) is formed at an opening (2) on an upper part of the sheath (1), so that a concave portion (5) formed at a saw handle (4) is elastically fitted in and held by the squeezed portion (3) at the opening (2) of the sheath (1). This configuration makes it possible to secure the saw inside the sheath (1) and prevent the saw from unintentionally falling out of the sheath.

PRIOR ART DOCUMENTS

Patent Documents

Patent Document 1: Japanese Utility Model Application Laid-Open No. 7-37585

Patent Document 2: Japanese Patent Application Laid-Open No. 11-9858

Patent Document 3: Japanese Patent Application Laid-Open No. 2005-131073

SUMMARY OF THE INVENTION

Problems to be Solved by the Invention

In the case of the saw sheath disclosed in Patent Document 1 above, however, although the saw body (1) can be effectively guided into the sheath (6), the saw-body inserting opening (3) is made wide so as to facilitate insertion of the saw body (1), which would also make the inserted saw body (1) readily fall out. Particularly, the rigid roller members (4) may guide the saw body in the opposite direction, making the saw body easy to fall out inadvertently.

Further, with the pair of rigid roller members (4) placed merely roughly near the opening, it is not possible to correct the orientation of the blade tip surface that has entered the sheath (6). When the blade tip surface of the saw body (1) is turned and misaligned with respect to the flat surfaces of the hollow inside the sheath (6), the blade tip may contact and damage the sheath inner wall, or the blade tip may be caught by the inner wall, hindering smooth insertion of the saw.

In the case of the sheath for a saw or the like disclosed in Patent Document 2 above, the rollers (3) are disposed on one side inside the main sheath body (1) to allow the blade portion (4) of the saw to move on the rollers. Although this configuration may be able to effectively prevent the sheath from being scraped off by the saw blade, it is not aimed at realizing smooth insertion of the saw from the entrance of the main sheath body (1), and it would not exert such functions and effects.

In the case of the sheath for a saw or the like disclosed in Patent Document 3 above, although the configuration prevents the saw inserted into the sheath (1) from slipping out of the sheath, the elastic fitting between the saw handle (4) and the sheath (1) is merely male/female fitting using the elasticity of a thin resin film; it is not intended for use in combination with rollers. Therefore, although the structure may be used for a while after removal of the package, it is actually a packing container with poor durability, which is easily scraped off by the saw blade and cannot be used repeatedly for a long time.

In view of the foregoing, an object of the present invention is to solve various problems of the conventional techniques as described above and to provide a saw sheath which allows a saw to be inserted to a sheath entrance easily, which prevents the inserted saw from easily falling out or rattling in the sheath, which allows the blade tip of the saw blade that has entered the sheath to be inserted all the way in smoothly without being caught by the inner wall, and which can thus sufficiently suppress scraping-off of the inner wall of the sheath by the saw blade.

Means for Solving the Problems

In order to achieve the above object, a saw sheath according to the present invention has a first feature that it includes a flat sheath opening section and a flat main sheath body continuing from the sheath opening section, a saw blade being inserted, from a blade tip thereof, into the main sheath body through the sheath opening section, wherein the sheath opening section has an opening width that is wider at an entrance thereof and becomes narrower with depth, a pair of guide rollers for guiding the blade tip into the sheath opening section are provided at the entrance of the sheath opening section, on respective sides in the width direction of the entrance, a pair of grip penetration preventing sections for preventing further penetration of a saw grip are provided behind the pair of guide rollers, with certain spacing secured between the grip penetration preventing section and the corresponding guide roller, and the certain spacing between the grip penetration preventing section and the corresponding guide roller constitutes an elastic grip-fitting space for receiving and elastically fitting a part of the saw grip therein.

Further, the saw sheath according to the present invention has, in addition to the above-described first feature, a second feature that a pair of second guide rollers are provided deep in an interior of the sheath opening section, on respective sides perpendicular to the width direction of the interior, the second guide rollers guiding the saw blade entering toward the main sheath body such that the orientation of the saw blade coincides with a flatwise direction of the main sheath body.

Furthermore, the saw sheath according to the present invention has, in addition to the above-described first or second feature, a third feature that a pair of third guide rollers for guiding the blade tip into the main sheath body are provided in front of the main sheath body, on the respective sides in the width direction of the sheath opening section.

Furthermore, the saw sheath according to the present invention has, in addition to any of the above-described first through third features, a fourth feature that the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

Effects of the Invention

According to the saw sheath recited in claim 1, the saw sheath is composed of the flat sheath opening section and the flat main sheath body continuing from the sheath opening section, and a saw blade is inserted from the sheath opening section into the main sheath body at the back of the sheath opening section. The sheath opening section has an entrance with a large opening width, and the pair of guide rollers are provided on the respective sides in the width direction of the entrance. Accordingly, the blade tip of the saw blade is readily guided by the guide rollers into the wide entrance of the sheath opening section and into the main sheath body.

Further, according to the saw sheath recited in claim 1, the pair of grip penetration preventing sections are provided behind the guide rollers in the sheath opening section. This prevents a saw grip, i.e. the grip of the saw, from further penetrating into the saw sheath, to thereby prevent the blade tip of the saw blade from coming into contact with the bottom of the saw sheath.

Particularly, certain spacing between the guide roller and the grip penetration preventing section behind it constitutes the elastic grip-fitting space for receiving and elastically fitting a part of the saw grip therein. Accordingly, when a front end portion of the saw grip is guided into the sheath opening section by the guide rollers and stopped by the grip penetration preventing sections, the saw is held in the position as each of the parts of the saw grip is elastically fitted in the elastic grip-fitting space between the grip penetration preventing section and the corresponding guide roller while being sandwiched therebetween. In the case of taking the saw out of the sheath, an operator may hold the saw grip and pull it in the pull-out direction, which causes the guide rollers to rotate to release the elastic fitting of the saw grip, so that the saw is pulled out of the sheath.

Therefore, according to the invention recited in claim 1, the saw inserted into the sheath is held stationarily in the inserted position, while it can be pulled out by releasing the elastic fitting easily by the rotation of the guide rollers.

As described above, according to the invention recited in claim 1, the guide rollers make it easy to insert the saw blade from the wide entrance. Further, the inserted saw blade is firmly secured, without rattling; the slipping out of the saw blade can be avoided reliably. Needless to say, the blade tip of the saw blade can be reliably guided, hardly damaging the inner wall of the sheath.

According to the saw sheath recited in claim 2, in addition to the effects achieved by the configuration recited in claim 1 as described above, the pair of second guide rollers are provided, deep in the interior of the sheath opening section, on the respective sides perpendicular to the width direction of the interior. The second guide rollers serve to guide the saw blade entering toward the main sheath body such that the orientation of the saw blade coincides with the flatwise direction of the main sheath body.

The blade tip of the saw blade that has entered through the entrance of the sheath opening section next reaches the pair of second guide rollers. The second guide rollers are disposed perpendicularly to the guide rollers at the entrance. That is, they are arranged on both sides perpendicular to the width direction of the interior of the flat sheath opening section. As the blade tip of the saw blade passes through between the pair of second guide rollers, the blade tip surface is guided to coincide with the flatwise direction of the interior of the sheath opening section. Needless to say, the surface of the saw blade that enters following the surface of the blade tip is also guided to coincide with the flatwise direction successively. That is, with the second guide rollers, the surface of the saw blade is corrected to coincide with the flatwise direction of the sheath, thereby ensuring smooth insertion of the saw blade into the main sheath body.

According to the saw sheath recited in claim 3, in addition to the functions and effects obtained by the configuration recited in claim 1 or 2 as described above, the pair of third guide rollers for guiding the blade tip into the main sheath body are provided, in front of the main sheath body, on the respective sides in the width direction of the sheath opening section.

With the third guide rollers, the blade tip that has entered from the wide entrance of the sheath opening section can further be guided before it reaches the main sheath body, thereby enabling smooth insertion of the saw blade into the thin and light-weight main sheath body. Further, even in the case where the main sheath body and the sheath opening section are formed separately and assembled together, the third guide rollers can cover the discontinuity such as a step caused by fitting between the main sheath body and the sheath opening section, thereby ensuring smooth guiding and insertion of the blade tip from the sheath opening section to the main sheath body without problems.

According to the saw sheath recited in claim 4, in addition to the functions and effects obtained by the configuration recited in any of claims 1 to 3 as described above, the sheath opening section is made up of a split body consisting of a lower sheath opening part and an upper sheath opening part, which can readily realize the configuration of the sheath opening section including the plurality of rollers disposed therein. Further, it is readily possible to replace the rollers and other components as necessary.

Particularly, at the time of joining the split body parts, the main sheath body can be sandwiched between the parts. This makes it possible to complete the sheath by readily providing the sheath opening section to the main sheath body prepared separately.

MODES FOR CARRYING OUT THE INVENTION

A saw sheath according to an embodiment of the present invention will be described with reference to the following drawings.

Figure 1:
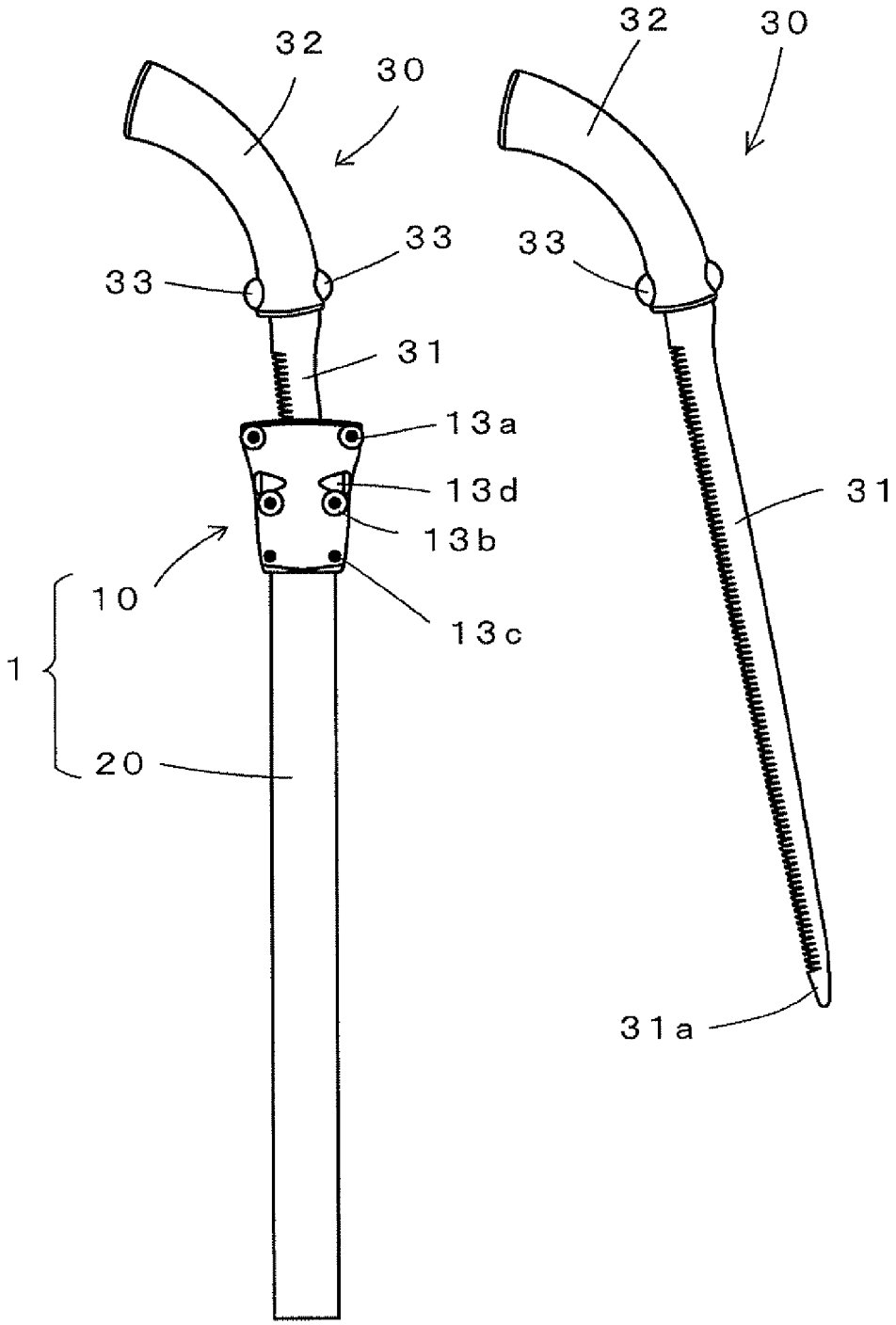
FIG. 1 shows a saw sheath and a saw according to an embodiment of the present invention.

Referring first to FIG. 1, a saw sheath 1 is made up of a sheath opening section 10 and a main sheath body 20. A saw 30 is removably inserted into the saw sheath 1.

Figure 2:
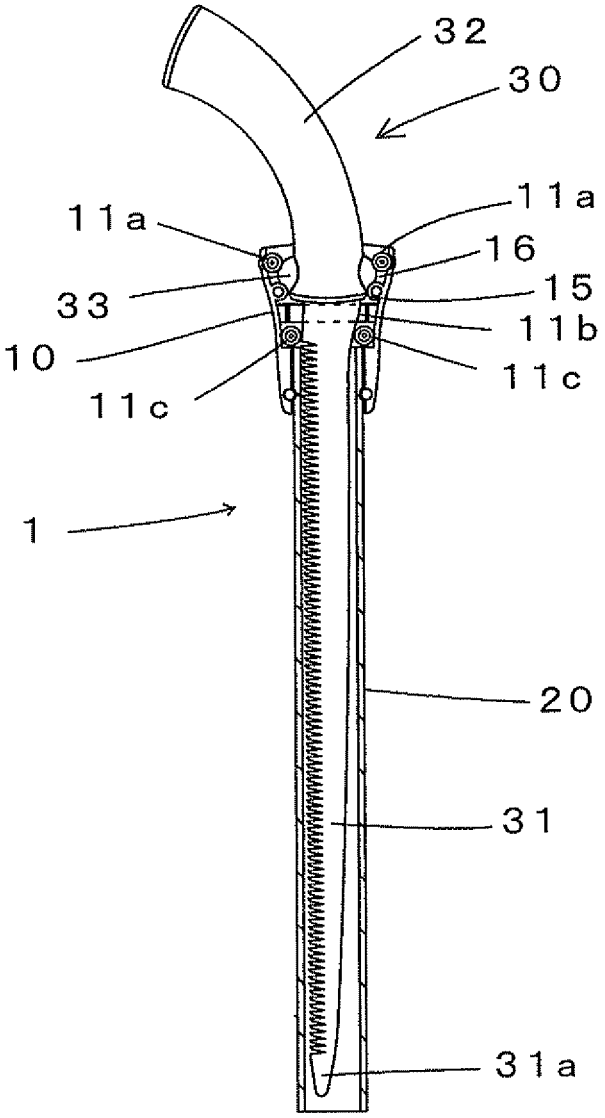
FIG. 2 shows the state where the saw is housed in the saw sheath, the main sheath body being shown in cross section, the sheath opening section being shown in the state where the upper sheath opening part has been removed.

FIG. 2 shows the state where the saw 30 is inserted and held in the saw sheath 1.

This saw sheath 1 is secured, for example, to the waist of an operator, by means of an attachment which is not shown.

The operator may take the saw 30 out of the saw sheath 1, when necessary, and put it in the saw sheath again when finishing the operation.

Figure 3:
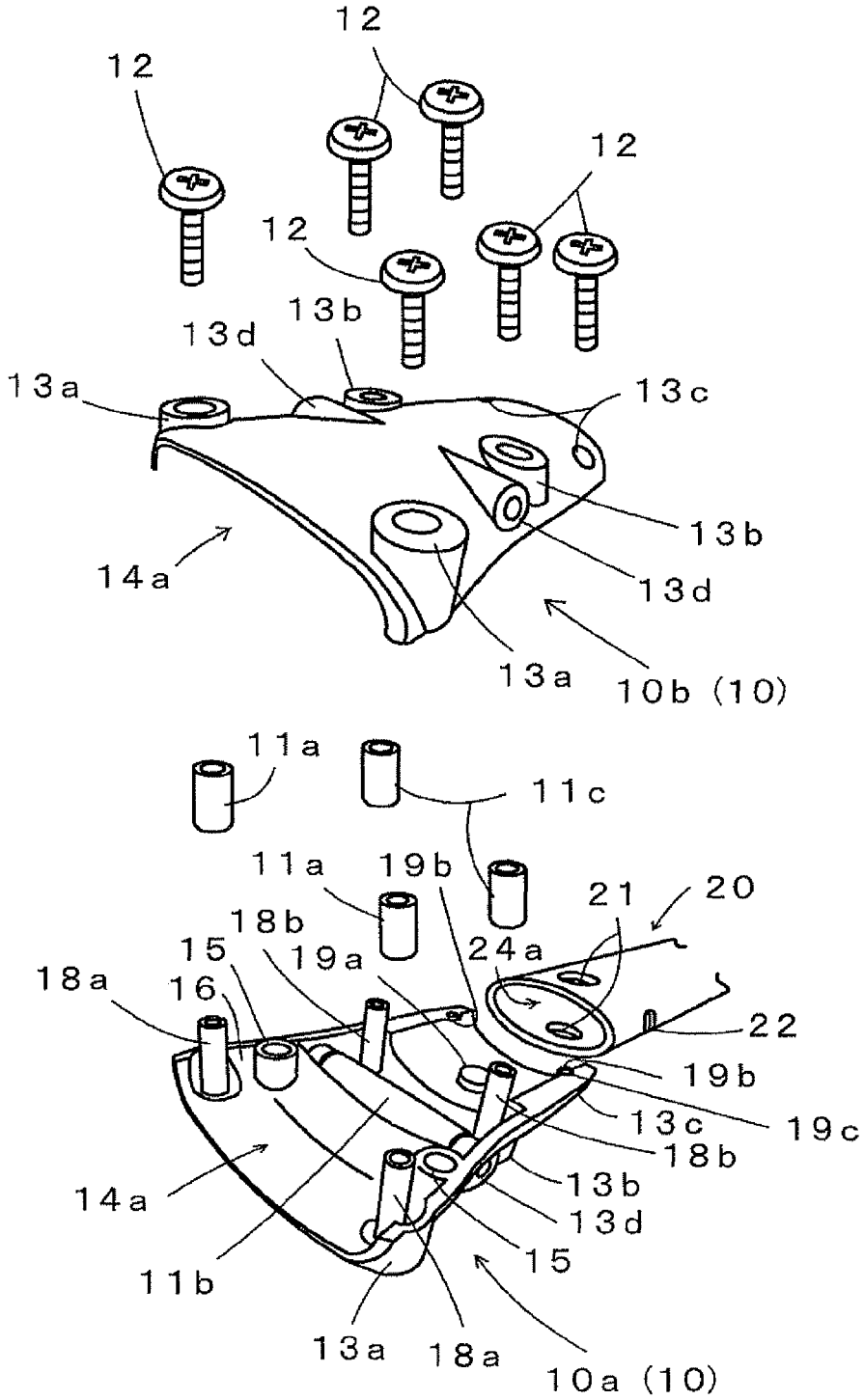
FIG. 3 is an exploded perspective view of the saw sheath according to the embodiment of the present invention.
Figure 4:
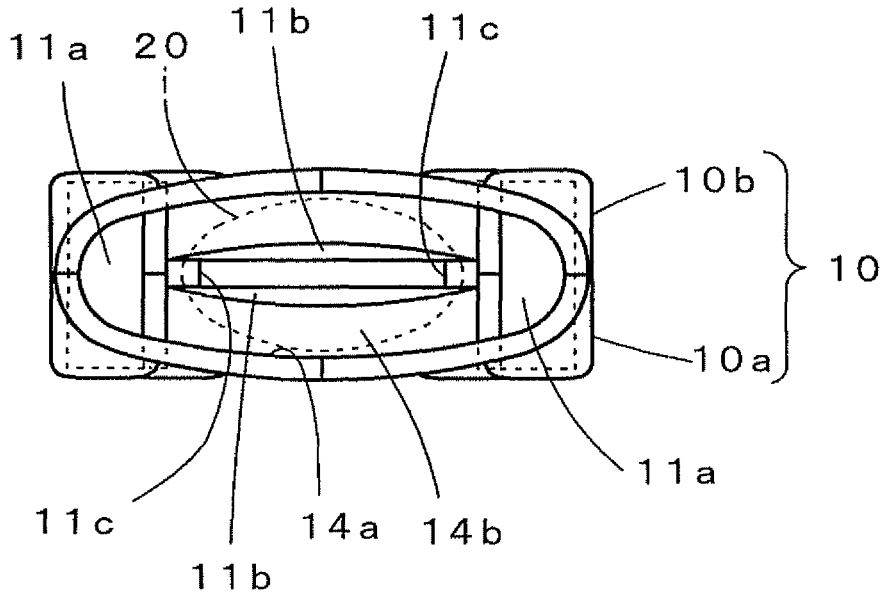
FIG. 4 shows an entrance of the sheath opening section of the saw sheath according to the embodiment of the present invention.
Figure 5:
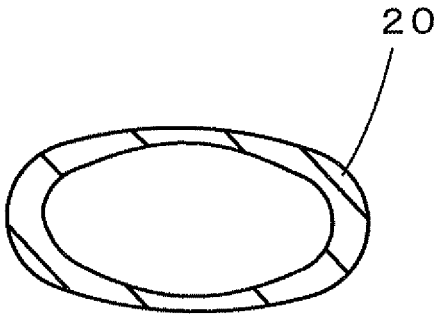
FIG. 5 is a cross-sectional view of the main sheath body of the saw sheath according to the embodiment of the present invention.
Figure 6:
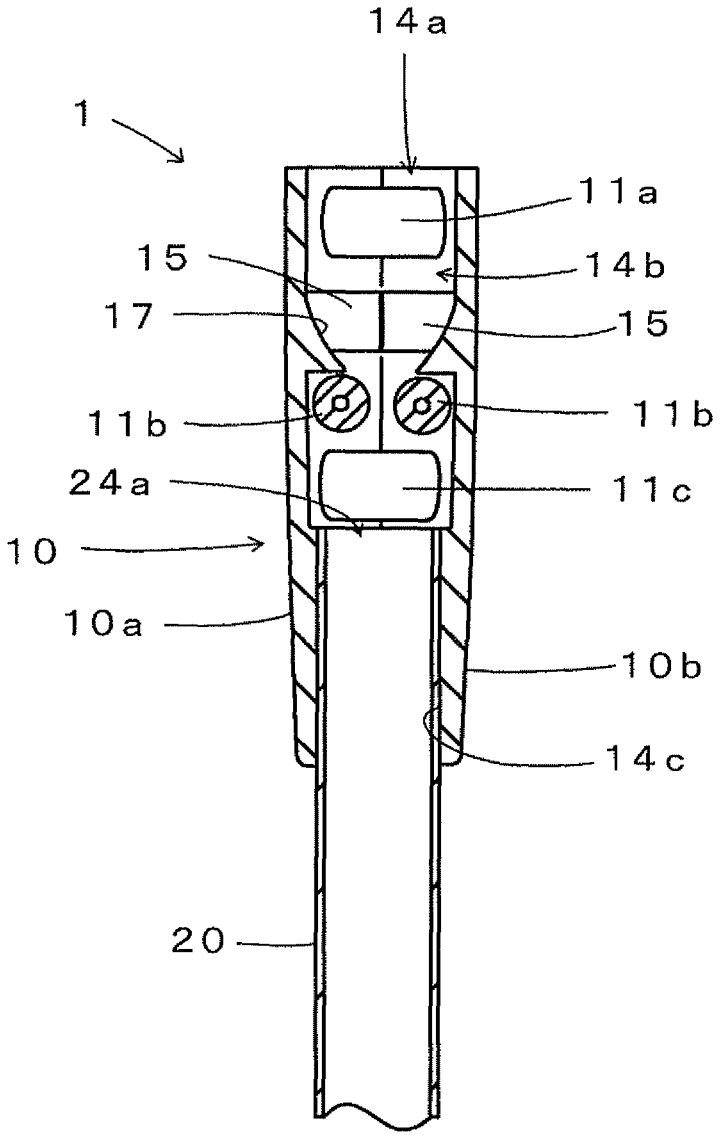
FIG. 6 is a vertical cross-sectional view of the saw sheath according to the embodiment of the present invention.

Referring to FIG. 3, the sheath opening section 10 of the saw sheath 1 is made up of a split body consisting of a lower sheath opening part 10*a* and an upper sheath opening part 10*b* which are joined in a separable manner. First guide rollers 11*a*, second guide rollers 11*b*, and third guide rollers 11*c* are also provided in such a manner that they are separable from the lower sheath opening part 10*a* and the upper sheath opening part 10*b*. The second guide roller 11*b* shown in FIG. 3, which has been attached to the lower sheath opening part 10*a*, is also separable. A second guide roller 11*b* is also attached to the upper sheath opening part 10*b* at the corresponding position. The second guide rollers 11*b* can be rotatably attached by pivot pins, screws, or other means.

The lower sheath opening part 10*a* and the upper sheath opening part 10*b* are separably joined by screws 12 to form the sheath opening section 10.

On the outer surface of the upper sheath opening part lob, a pair of first screw supports 13*a*, a pair of second screw supports 13*b*, and a pair of third screw supports 13*c* are provided on the respective sides in the width direction (shorter direction), at the front, middle, and back, respectively, in the longitudinal direction. Further, in front of the pair of second screw supports 13*b*, a pair of pivot pin supports 13*d* for attachment of the second guide roller 11*b* are provided on the respective sides in the width direction.

Although not fully illustrated, the outer surface of the lower sheath opening part 10*a* is identical in shape to the outer surface of the upper sheath opening part 10*b* described above. That is, on the outer surface of the lower sheath opening part 10*a* as well, pairs of first screw supports 13*a*, second screw supports 13*b*, third screw supports 13*c*, and pivot pin supports 13*d* are provided.

The screws 12 are ones common to the screw supports 13*a*, 13*b*, 13*c*, and 13*d*.

It is noted that the lower sheath opening part 10*a* and the upper sheath opening part 10*b* do not have a particular relationship in terms of up and down. One of the halves constituting the mouth structure of the sheath opening section 10 is called the lower sheath opening part, and the other is called the upper sheath opening part, for convenience' sake.

The main sheath body 20 is a long and thin, flat tubular body (see FIGS. 1 to 3 and FIG. 5), and has its distal end closed as necessary. The length of the main sheath body 20, its width (length in the longer diameter direction of the flat oval cross section), and its thickness (length in the shorter diameter direction of the flat oval cross section) are each preferably set as short as possible within the range capable of housing the saw blade, for reduction in weight.

For the main sheath body 20, synthetic resin, light metal such as aluminum, or other materials may be used.

Near the proximal end of the main sheath body 20, a pair of fitting holes 21 or fitting depressions are provided on the upper and lower flat surfaces, and a pair of fitting grooves 22 or fitting notches are provided on the respective sides, as fitting means for use in mating with the lower sheath opening part 10*a* and the upper sheath opening part l0*b*.

The main sheath body 20 is sandwiched between the lower sheath opening part 10*a* and the upper sheath opening part 10*b* so as to be integrated with the sheath opening section 10.

Referring to FIG. 4 and FIGS. 6 to 8 as well, the sheath opening section 10 formed by joining the lower sheath opening part 10*a* and the upper sheath opening part 10*b* is a flat tubular body having an entrance 14*a* in an oval or flattened circular shape, and an interior 14*b* continuing from the entrance.

The sheath opening section 10 has an opening width that is wider at the entrance 14*a* and becomes narrower in the depth direction of the interior 14*b*. The deepest part of the interior 14*b* constitutes a fitting space 14*c* which is shaped to exactly receive the proximal end and its vicinity of the main sheath body 20.

The outer width of the sheath opening section 10 is also decreased from the front end (where the entrance 14*a* is located) gradually in the longitudinal direction, and at the rear end, it is close to the diameter of the main sheath body 20.

The pair of first guide rollers 11*a* are disposed on the respective sides in the width direction at the entrance 14*a* of the sheath opening section 10. The first guide rollers 11*a* serve to guide the blade tip 31*a* of the saw blade 31 into the sheath opening section 10. More specifically, the first guide rollers 11*a* are arranged, on the respective sides of the flattened entrance 14*a*, such that the roller axis is perpendicular to the flat surfaces (such that the roller axis corresponds to the shorter direction of the flattened entrance 14*a*).

As the first guide rollers 11*a* are disposed on the respective sides of the entrance 14*a* which is sufficiently greater in opening size than an entrance 24*a* of the main sheath body 20, the rollers are able to easily guide the blade tip 31*a* of the saw blade 31 into the sheath opening section 10. Moreover, as the first guide rollers 11*a* rotate while guiding, the blade tip 31*a* and other parts of the saw 30 come into contact with the roller 11*a* surfaces and move in accordance with the rotation of the rollers, so as to be smoothly guided into the sheath opening section 10.

Furthermore, deep in the sheath opening section 10, or, at the back end of the interior 14*b*, the pair of third guide rollers 11*c* are disposed on the respective sides in the width direction of the interior. The third guide rollers 11*e* are arranged in front of the entrance of the main sheath body 20 such that the distance between the third guide rollers 11*c* is not greater than the width of the entrance 24*a* of the main sheath body 20. The third guide rollers 11*c* are arranged in the same direction as the first guide rollers 11*a*. With this configuration, the blade tip 31*a* that has entered from the entrance 14*a* into the interior 14*b* is guided by the third guide rollers 11*c* and advances in accordance with the rotation of the rollers, so that it is quickly and smoothly guided into the main sheath body 20.

The second guide rollers 11*b* are disposed at an intermediate position between the first guide rollers 11*a* and the third guide rollers 11*c*. The second guide rollers 11*b* are arranged in a direction perpendicular to the direction in which the first guide rollers 11*a* and the third guide rollers 11*c* are arranged. That is, the second guide rollers 11*b* are disposed on the respective sides in the direction perpendicular to the width direction of the interior 14*b* of the sheath opening section 10. More specifically, the pair of second guide rollers 11*b* are disposed, apart from each other, in parallel with the flat surfaces of the flattened interior 14*b*.

The pair of second guide rollers 11*b* are arranged such that the gap therebetween is smaller than the size of the flattened entrance 24*a* of the main sheath body 20 in the direction (shorter direction of the entrance) perpendicular to the width direction (flatwise direction) thereof. With this configuration, the blade tip 31*a* of the saw blade 31 that has been guided through the first guide rollers 11*a* to the second guide rollers 11*b* is corrected such that the orientation of the blade tip 31*a* surface coincides with the flatwise direction of the interior 14*b* of the sheath opening section 10 and the flatwise direction of the entrance 24*a* of the main sheath body 20. This makes the blade tip 31*a* ready to smoothly enter into the following entrance 24*a* of the main sheath body 20.

Behind the pair of first guide rollers 11*a*, a pair of grip penetration preventing sections 15 are provided, with certain spacing secured between the same and the first guide rollers 11*a*.

The grip penetration preventing section 15 is for preventing further penetration of a saw grip 32 that has entered from the entrance 14*a* to the interior 14*b* of the sheath opening section 10. More specifically, the grip penetration preventing sections 15 are disposed behind the first guide rollers 11*a* and in front of the second guide rollers 11*b*.

The grip penetration preventing sections 15 may be posts which are arranged at the respective sides in the width direction of the interior 14*b* to protrude in the same direction as the axis direction of the first guide rollers 14*a*.

Each grip penetration preventing section 15 has its lower half formed on the lower sheath opening part 10*a* and its upper half formed on the upper sheath opening part 10*b*. As the lower sheath opening part 10*a* and the upper sheath opening part 10*b* are integrated into one piece, the lower half and the upper half of the grip penetration preventing section 15 are integrated into one post.

In relation to the pair of grip penetration preventing sections 15, a pair of bulging sections 33 are provided on the saw grip 32, on the respective sides near the front end thereof. As the saw grip 32 advances, when the bulging sections 33 reach the grip penetration preventing sections 15, further penetration of the saw grip is prevented by the grip penetration preventing sections 15.

The bulging sections 33 are part of the saw grip 32. They are formed of elastically deformable rubber or plastic.

The distance between the pair of bulging sections 33 is set to be slightly greater than the spacing between the pair of first guide rollers 11*a*. Using an elastically deformable material for the pair of bulging sections 33 as described above allows the bulging sections 33 to move beyond the pair of first guide rollers 11*a*, while being elastically deformed, to enter the sheath opening section 10. The deformability for the elastic deformation described above is set to the level enabling the bulging sections to move beyond the first guide rollers 11*a*.

Certain spacing between the first guide roller 11*a* and the grip penetration preventing section 15 disposed behind it constitutes an elastic grip-fitting space 16.

The elastic grip-fitting space 16 is a space in which the bulging section 33 of the saw grip 32 is fitted elastically. The bulging section 33 is elastically fitted in the elastic grip-fitting space 16 in the state where it is sandwiched between the grip penetration preventing section 15 and the first guide roller 11*a*.

When the front end and its vicinity of the saw grip 32 enter the sheath opening section 10, the bulging sections 33 move beyond the first guide rollers 11*a* and are elastically fitted in the elastic grip-fitting spaces 16; further penetration is prevented by the grip penetration preventing sections 15. On the other hand, for taking the saw 30 out of the saw sheath 1, the saw grip 32 may be pulled such that the bulging sections 33 located in the elastic grip-fitting spaces 16 move beyond the first guide rollers 11*a* and exit from the sheath opening section 10.

In the interior 14*b* of the sheath opening section 10, a pair of sloped guide surfaces 17 are provided in front of the second guide rollers 11*b*, to guide the blade tip 31*a* of the saw blade 31 toward the gap between the pair of second guide rollers 11*b*. The saw blade 31 that has passed the first guide rollers 11*a* comes into contact with and is guided by the sloped guide surfaces 17, so that the blade tip 31*a* is corrected in surface orientation and guided into the gap between the pair of second guide rollers 11*b*.

The lower sheath opening part 10*a* and the upper sheath opening part 10*b* will be described below for providing a more detailed description of the structure of the sheath opening section 10.

Figure 7:
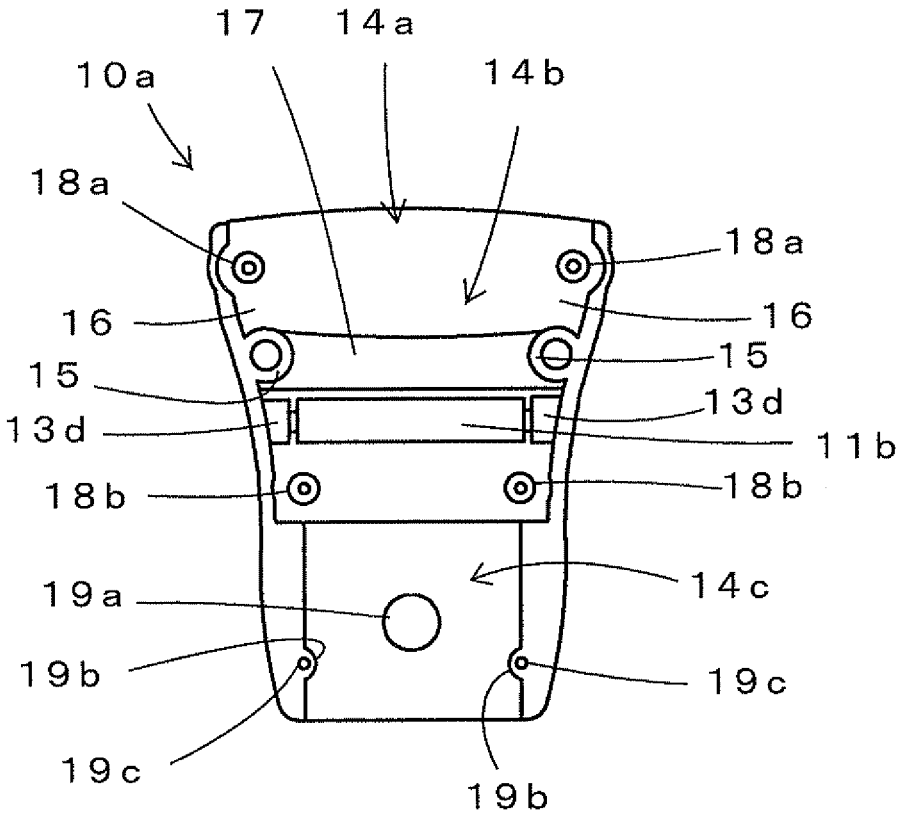
FIG. 7 shows an inner surface of the lower sheath opening part of the sheath opening section of the saw sheath according to the embodiment of the present invention.
Figure 8:
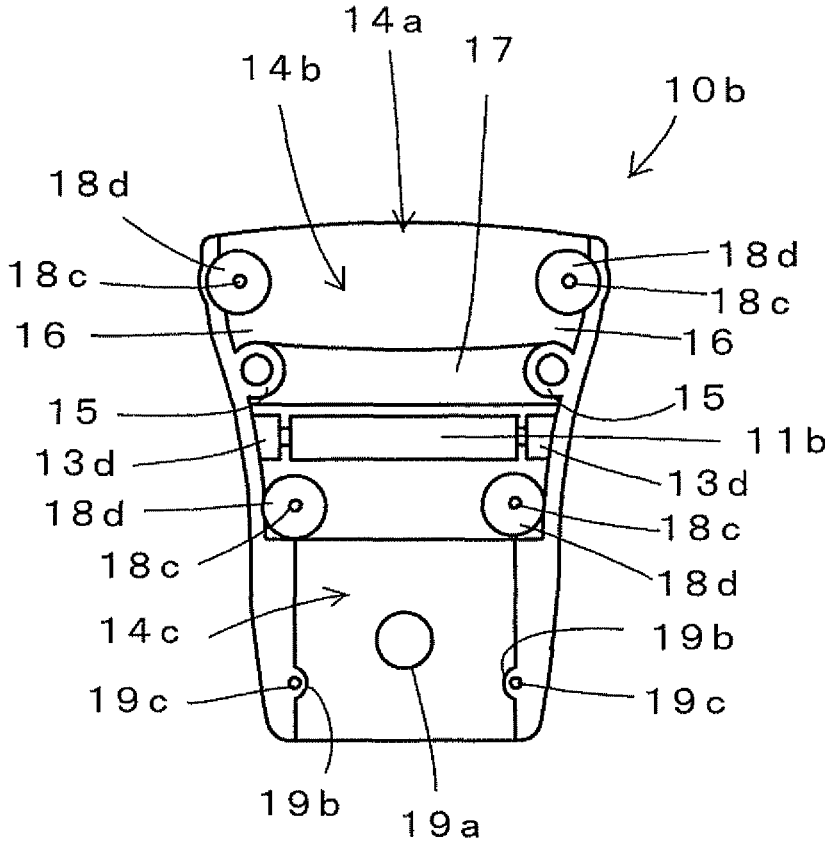
FIG. 8 shows an inner surface of the upper sheath opening part of the sheath opening section of the saw sheath according to the embodiment of the present invention.

Referring to FIGS. 3, 7, 8 etc., at the entrance 14*a* of the lower sheath opening part 10*a*, on the respective sides on the inner surface, a pair of first pivot posts 18*a* are integrally formed upright (in the shorter direction perpendicular to the longer direction of the entrance 14*a*). The first pivot posts 18*a* are pivot posts onto which the first guide rollers 11*a* are fitted rotatably. The first pivot posts 18*a* are in a tubular shape for receiving the screws 12.

Similarly, deep in the interior 14*b* of the lower sheath opening part 10*a*, a pair of second pivot posts 18*b* are integrally formed upright on the respective sides. The second pivot posts 18*b* are pivot posts onto which the third guide rollers 11*c* are fitted rotatably. The second pivot posts 18*b* are also in a tubular shape for receiving the screws 12.

The upper sheath opening part 10*b* is not provided with the first pivot posts 18*a* or the second pivot posts 18*b*. Merely provided at the corresponding positions are holes 18*c*, each communicating with the first screw support 13*a* or the second screw support 13*b*, and depressions 18*d*, each receiving the first guide roller 11*a* or the third guide roller 11*c*.

Forming the pivot posts for both half parts together on the lower sheath opening part 10*a* side, while forming no pivot posts on the upper sheath opening part 10*b* side, can prevent occurrence of misalignment upon insertion of the first guide rollers 11*a*, the third guide rollers 11*c*, as well as the screws 12.

The lower sheath opening part 10*a* and the upper sheath opening part 10*b* are identical in configuration, except the first pivot posts 18*a* and the second pivot posts 18*b*.

Deep in the interior 14*b* of the lower sheath opening part 10*a*, in front of the second pivot posts 18*b*, a pair of pivot pin supports 13*d* are provided on the respective sides to face each other in the horizontal direction (in the opening width direction of the interior 14*b*). Between the pivot pin supports 13*d*, one of the two second guide rollers 11*b* is pivotally supported in a rotatable manner. The second guide roller 11*b* is also detachable from the lower sheath opening part 10*a*.

Similarly, a pair of pivot pin supports 13*d* are provided to face each other, at the positions on the upper sheath opening part 10*b* corresponding to those on the lower sheath opening part 10*a*, and the other one of the second guide rollers 11*b* is disposed as well.

Further, behind the pair of first pivot posts 18*a* on the lower sheath opening part 10*a*, on the respective sides of the interior 14*b*, the lower halves of the pair of grip penetration preventing sections 15 are integrally formed as tubular posts. The grip penetration preventing section 15 does not necessarily have to be tubular.

Similarly, at the corresponding positions on the upper sheath opening part 10*b*, the upper halves of the pair of grip penetration preventing sections 15 are integrally formed as tubular posts.

Furthermore, deep in the interior 14*b* of the lower sheath opening part 10*a*, at the position in front of the second guide roller 11*b*, a lower sloped guide surface 17 out of the upper and lower sloped guide surfaces 17 is formed.

Similarly, at the corresponding position on the upper sheath opening part 10*b*, the upper sloped guide surface 17 out of the upper and lower sloped guide surfaces 17 is formed.

Still further, in the fitting space 14*c* at the deepest part of the interior 14*b* of the lower sheath opening part 10*a*, a fitting projection 19*a* is formed at the center, and fitting ridges 19*b* and holes 19*c* are formed on the respective sides thereof. The fitting projection 19*a* is fitted into the fitting hole 21 in the main sheath body 20, and the fitting ridges 19*b* are fitted into the fitting grooves 22 in the main sheath body 20. The holes 19*c* are threaded holes which continue to the third screw supports 13*c*.

Similarly, at the corresponding positions on the upper sheath opening part 10*b*, a fitting projection 19*a*, fitting ridges 19*b*, and holes 19*c* are formed.

Assembly of the saw sheath 1 will now be described.

First, the first guide rollers 11*a* and the third guide rollers 11*c* are fitted onto the first pivot posts 18*a* and the second pivot posts 18*b* on the lower sheath opening part 10*a*. The main sheath body 20 is also fitted into the fitting space 14*c* in the lower sheath opening part 10*a*. For fitting, the fitting hole 21 and the fitting grooves 22 formed near the proximal end of the main sheath body 20 are fitted with the fitting projection 19*a* and the fitting grooves 19*b* on the lower sheath opening part 10*a*.

Next, the upper sheath opening part 10*b* is placed over the lower sheath opening part 10*a* and the main sheath body 20 for fitting, and the screws 12 are inserted and screwed into the first screw supports 13*a*, the second screw supports 13*b*, and the third screw supports 13*c*.

The above completes the assembly of the saw sheath 1. The saw sheath 1 may be disassembled by unscrewing the screws 12.

An operation of inserting the saw 30 or the saw blade 31 into the saw sheath 1 will be described with reference to FIGS. 9 to 13. In FIGS. 9 through 13, for simplicity's sake, the sheath opening section 10 is shown in the state where the upper sheath opening part 10*b* has been removed.

Generally, the saw sheath 1 is secured, for example, to the waist of an operator by means of an attachment, with the entrance 14*a* of the sheath opening section 10 being open upward.

Figure 9:
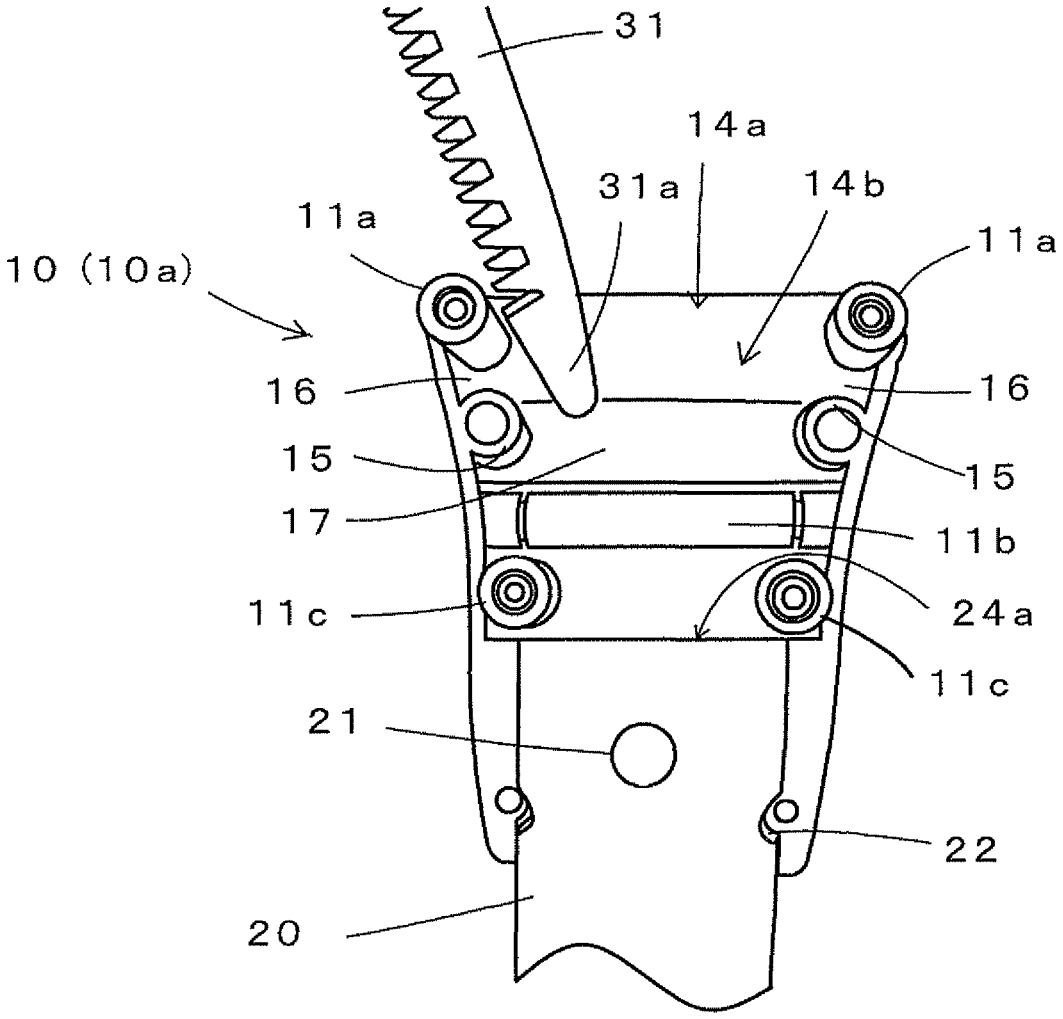
FIG. 9 illustrates a first stage of insertion of a saw blade into the saw sheath according to the embodiment of the present invention.

Referring first to FIG. 9, the operator who wishes to put the saw blade 31 in the saw sheath 1 holds the saw grip 32 and places the blade tip 31*a* of the saw blade 31 on the wide entrance 14*a* of the sheath opening section 10. At the entrance 14*a*, the pair of freely rotatable first guide rollers 11*a* are arranged on the respective sides. The blade tip 31*a* abuts against one of the first guide rollers 11*a* and is guided into the interior 14*b* with the rotation of the roller.

Figure 10:
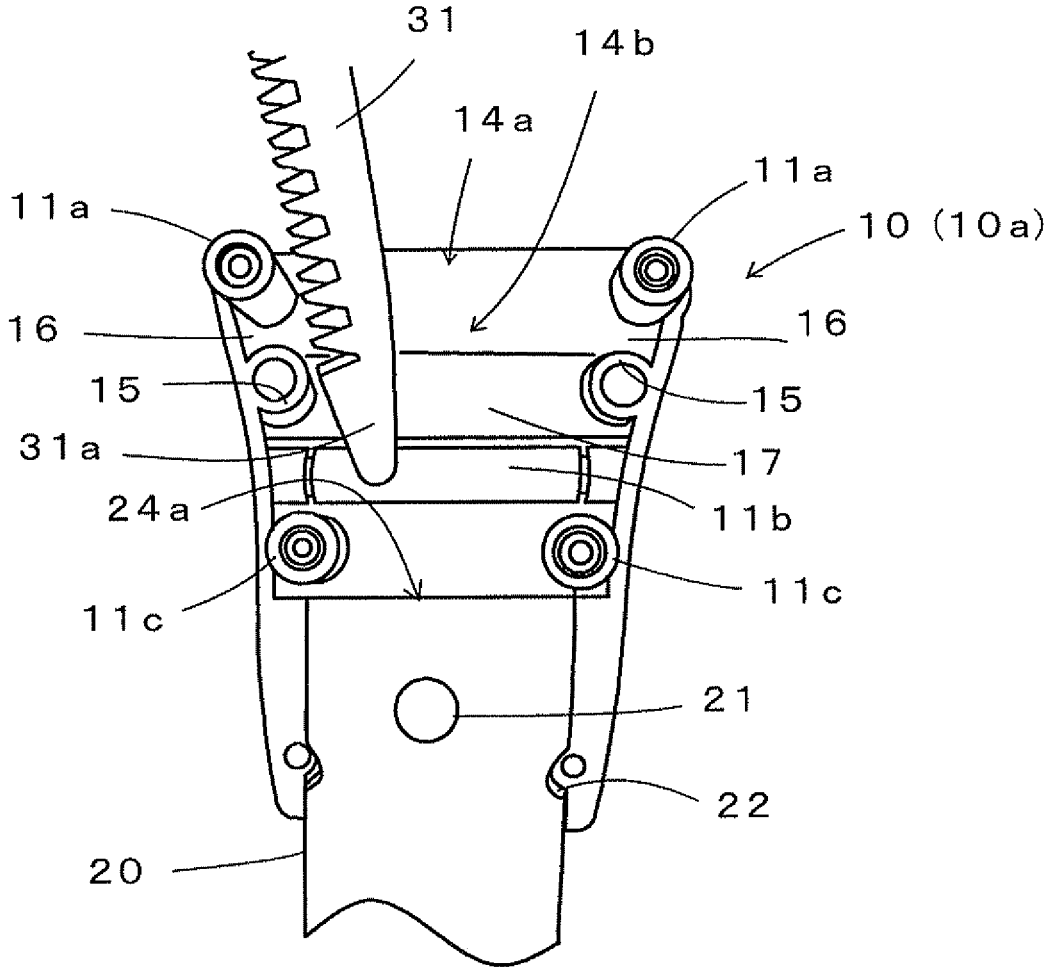
FIG. 10 illustrates a second stage of insertion of the saw blade into the saw sheath according to the embodiment of the present invention.

Referring to FIG. 10, the blade tip 31*a* that has entered the interior 14*b* advances through the interior 14*b*, the opening width of which gradually becomes narrower, and comes to abut against the sloped guide surface 17 on one of the lower sheath opening part 10*a* and the upper sheath opening part 10*b*. While being guided along the sloped guide surface 17, the blade tip 31*a* is corrected in position so as to be directed to the gap between the pair of second guide rollers 11*b* ahead, and then guided into between the pair of second guide rollers 11*b*.

As the blade tip 31*a* passes between the second guide rollers 11*b* while being guided by the rotation thereof, the orientation of the blade tip 31*a* surface is corrected such that it coincides with the direction of the gap between the second guide rollers 11*b*. In this manner, the surfaces of the blade tip 31*a* and the succeeding saw blade 31 are aligned with the flatwise direction of the entrance 24*a* of the main sheath body 20 which is waiting ahead.

Figure 11:
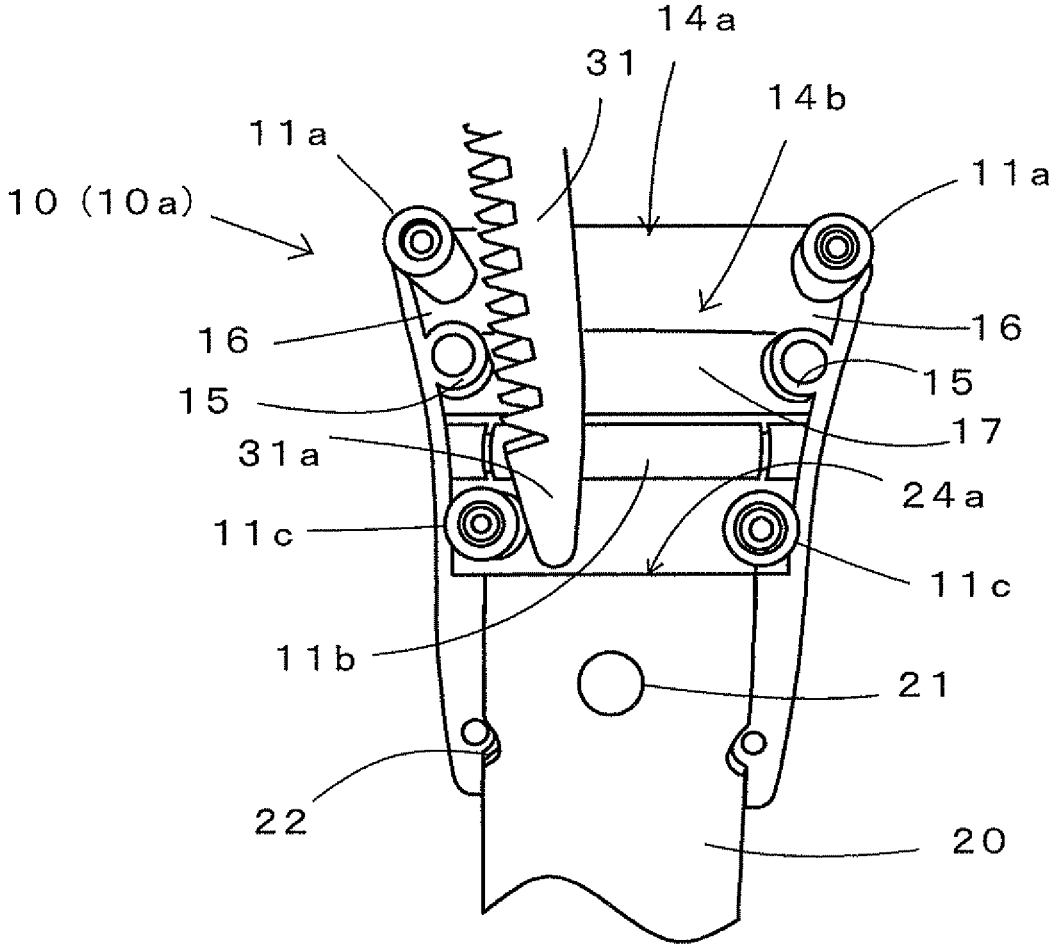
FIG. 11 illustrates a third stage of insertion of the saw blade into the saw sheath according to the embodiment of the present invention.

Referring to FIG. 11, the blade tip 31*a* that has passed between the second guide rollers 11*b* reaches the pair of third guide rollers 11*c*, and is guided by the third guide rollers 11*c* into the spacing between them. With the third guide rollers 11*c*, the position of the blade tip 31*a* is restricted within the range of the opening width of the entrance 24*a* (width in the longer direction of the entrance) of the main sheath body 20 which is located immediately behind the rollers. The blade tip 31*a* that has been restricted in position smoothly enters the entrance 24*a* of the main sheath body 20 which is open in the direction of forward movement.

Figure 12:
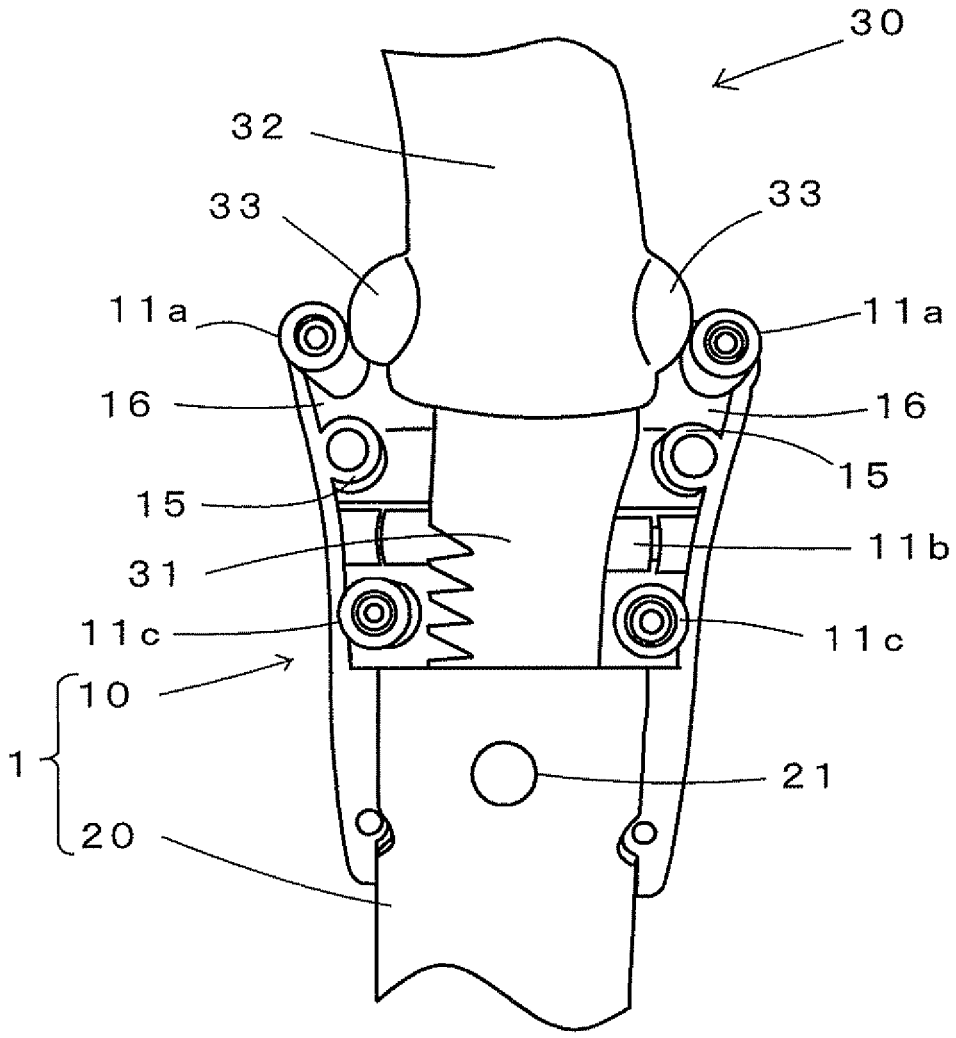
FIG. 12 illustrates a fourth stage of insertion of the saw blade into the saw sheath according to the embodiment of the present invention.

Referring to FIG. 12, as the saw blade 31 of the saw 30 is inserted into the main sheath body 20 from its blade tip 31*a*, the bulging sections 33 arranged on the respective sides near the front end of the saw grip 32 lastly reach the entrance 14*a* of the sheath opening section 10. The distance between the bulging sections 33 is made slightly greater than the distance between the first guide rollers 11*a* disposed on the respective sides of the entrance 14*a*. The bulging sections 33 have at least a certain level of elastic deformability. Therefore, when the saw grip 32 is pushed forward with little force, the bulging sections 33 are guided by the rotation of the first guide rollers 11*a* and enter from the entrance 14*a* into the interior 14*b* by moving beyond the first guide rollers 11*a*.

Figure 13:
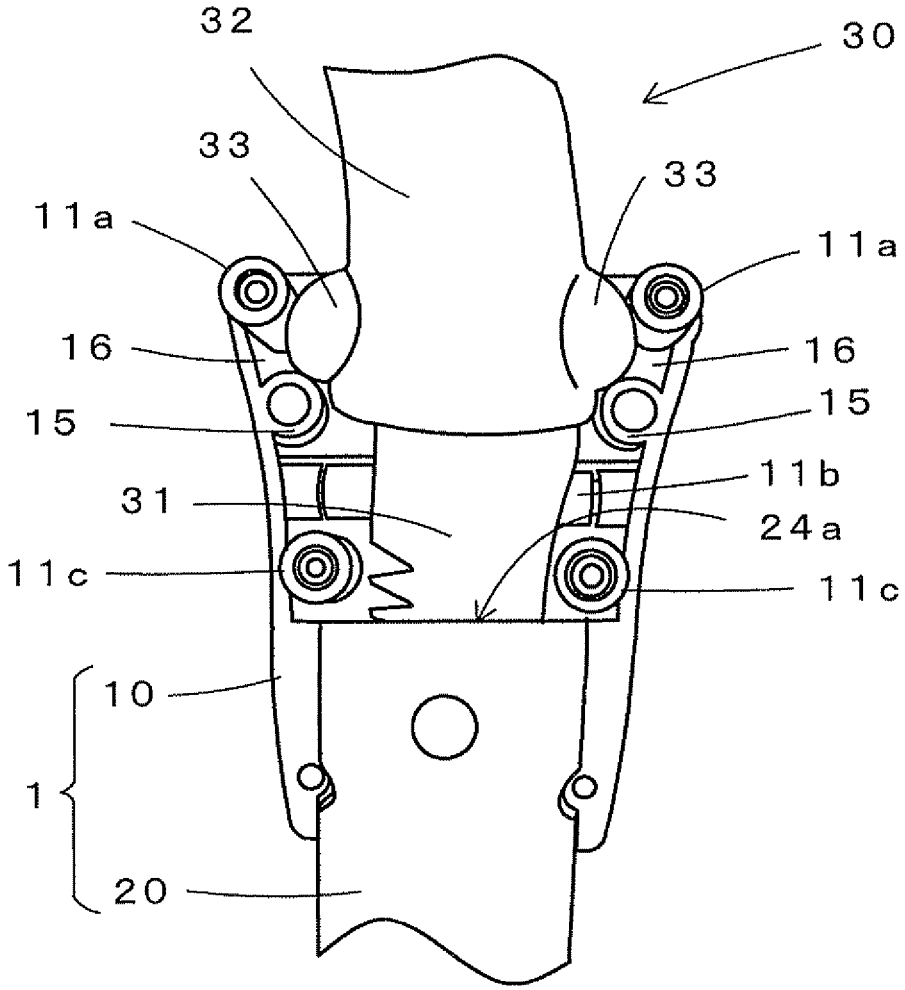
FIG. 13 illustrates a fifth stage of insertion of the saw blade into the saw sheath according to the embodiment of the present invention.

Referring to FIG. 13, the pair of bulging sections 33 that have moved beyond the first guide rollers 11*a* are prevented from further moving forward by the grip penetration preventing sections 15. This results in only the front end and its vicinity of the saw grip 32 entering the saw sheath 1.

The bulging sections 33, the further penetration of which has been prevented by the grip penetration preventing sections 15, are held in the state where they are elastically fitted in the elastic grip-fitting spaces 16 between the grip penetration preventing sections 15 and the first guide rollers 11*a*.

The saw 30 is housed and held in the saw sheath 1 in the state shown in FIG. 13.

For taking the saw 30 out of the saw sheath 1, an operator may grab the saw grip 32 and pull the saw by applying little force. This causes the bulging sections 33 to move beyond the first guide rollers 11*a*, while rotating the rollers, whereby the saw 30 can be taken out of the saw sheath 1.

In the case where the saw sheath 1 is to be secured to an operator by means of an attachment provided on the lower sheath opening part 10*a* side out of the lower sheath opening part 10*a* and the upper sheath opening part 10*b* of the sheath opening section 10, a blade tip receiving section may be provided at the entrance 14*a* of the lower sheath opening part 10*a*, such that the lower sheath opening part 10*a* side extends and protrudes compared to the upper sheath opening part 10*b* side. Forming the blade tip receiving section on the lower sheath opening part 10*a* is advantageous in that the blade tip receiving section can guide the blade tip 31*a* of the saw blade 31 to the entrance 14*a*, while preventing the blade tip from coming into contact with the operator's body.

Industrial Applicability

The saw sheath according to the present invention has an industrial application, together with a saw, as a sheath for housing the saw.

DESCRIPTION OF THE REFERENCE CHARACTERS

1 saw sheath
10 sheath opening section
10*a* lower sheath opening part
10*b* upper sheath opening part
11*a* first guide roller
11*b* second guide roller
11*c* third guide roller
12 screw
13*a* first screw support
13*b* second screw support
13*c* third screw support
13*d* pivot pin support
14*a* entrance
14*b* interior
14*c* fitting space
15 grip penetration preventing section
16 elastic grip-fitting space
17 sloped guide surface
18*a* first pivot post
18*b* second pivot post
18*c* hole
18*d* depression
19*a* fitting projection
19*b* fitting ridge
19*c* hole
20 main sheath body
21 fitting hole
22 fitting groove
24*a* entrance
30 saw
31 saw blade
31*a* blade tip
32 saw grip
33 bulging section

What is claimed is:

1. In combination, a saw sheath, including a flat sheath opening section and a flat main sheath body continuing from the sheath opening section, and a saw including a saw blade being inserted, from a blade tip thereof, into the main sheath body through the sheath opening section, and a saw grip providing an elastically deformable bulging section thereof, wherein the sheath opening section has an opening width that is wider at an entrance thereof and becomes narrower with depth, a pair of guide rollers for guiding the blade tip into the sheath opening section are provided at the entrance of the sheath opening section, on respective sides in a width direction of the entrance, a pair of grip penetration preventing sections for preventing further penetration of the saw grip are provided behind the pair of guide rollers, and a grip-fitting space for receiving and fitting the elastically deformable bulging section of the saw grip moving beyond the guide roller elastically is secured between the grip penetrating section and the corresponding guide roller; and wherein a pair of second guide rollers are provided deep in an interior of the sheath opening section, on respective sides perpendicular to the width direction of the interior, the second guide rollers guiding the saw blade entering toward the main sheath body such that the orientation of the saw blade coincides with a flatwise direction of the main sheath body.

2. The saw sheath combination according to claim 1, wherein a pair of third guide rollers for guiding the blade tip into the main sheath body are provided in front of the main sheath body, on the respective sides in the width direction of the sheath opening section.

3. The saw sheath combination according to claim 1, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

4. The saw sheath combination according to claim 1, wherein a pair of third guide rollers for guiding the blade tip into the main sheath body are provided in front of the main sheath body, on the respective sides in the width direction of the sheath opening section.

5. The saw sheath combination according to claim 1, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

6. The saw sheath combination according to claim 2, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

7. The saw sheath combination according to claim 4, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

8. A saw sheath comprising a flat sheath opening section for receiving a saw blade being inserted blade tip first, a flat main sheath body continuing from the sheath opening section for receiving the saw blade through the sheath opening section, wherein the sheath opening section has an opening width that is wider at an entrance thereof and becomes narrower with depth, a pair of guide rollers for guiding the blade tip and blade into the sheath opening section fixed at the entrance of the sheath opening section, on respective sides in a width direction of the entrance, a pair of grip penetration preventing sections for preventing further penetration of a saw grip, fixed at a distance behind the pair of guide rollers to provide a grip-fitting space for receiving and elastically securing a part of the saw grip between the grip penetration preventing section and the corresponding guide roller;

wherein a pair of second guide rollers are provided deep in an interior of the sheath opening section, on respective sides perpendicular to the width direction of the interior, the second guide rollers guiding the saw blade entering toward the main sheath body such that the orientation of the saw blade coincides with a flatwise direction of the main sheath body.

9. The saw sheath according to claim 8, wherein a pair of third guide rollers for guiding the blade tip into the main sheath body are provided in front of the main sheath body, on the respective sides in the width direction of the sheath opening section.

10. The saw sheath according to claim 8 wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

11. The saw sheath according to claim 8, wherein a pair of third guide rollers for guiding the blade tip into the main sheath body are provided in front of the main sheath body, on the respective sides in the width direction of the sheath opening section.

12. The saw sheath according to claim 8, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

13. The saw sheath according to claim 9, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

14. The saw sheath according to claim 11, wherein the flat sheath opening section is made up of a split body consisting of a lower sheath opening part and an upper sheath opening part separably joined to each other, and the flat main sheath body has a front end portion sandwiched between the lower sheath opening part and the upper sheath opening part so as to be integrated with the sheath opening section.

15. In combination, a saw sheath, including a flat sheath opening section and a flat main sheath body continuing from the sheath opening section, and a saw including a saw blade being inserted, from a blade tip thereof, into the main sheath body through the sheath opening section, and a saw grip providing an elastically deformable bulging section thereof, wherein the sheath opening section has an opening width that is wider at an entrance thereof and becomes narrower with depth, a pair of guide rollers for guiding the blade tip into the sheath opening section are provided at the entrance of the sheath opening section, on respective sides in a width direction of the entrance, a pair of grip penetration preventing sections for preventing further penetration of the saw grip are provided behind the pair of guide rollers, and a grip-fitting space for receiving and fitting the elastically deformable bulging section of the saw grip moving beyond the guide roller elastically is secured between the grip penetrating section and the corresponding guide roller;

the distance between the outside surfaces of the pair of elastically deformable bulging section is set to be slightly greater than the spacing between the inside surface of the pair of guide rollers, for enabling the pair of elastically deformable bulging sections to push, rotate the guild rollers, to move beyond guide rollers, and to push the way of them into the grip-fitting space while being deformed, and to get sandwiched and fixed elastically between the guide rollers and the grip penetration preventing sections.

* * * * *